US007340035B2

(12) United States Patent
Tang

(10) Patent No.: US 7,340,035 B2
(45) Date of Patent: Mar. 4, 2008

(54) X-RAY TUBE CATHODE OVERVOLTAGE TRANSIENT SUPRESSION APPARATUS

(75) Inventor: Liang Tang, Waukesha, WI (US)

(73) Assignee: General Electric Company, Schenectady, NY (US)

( * ) Notice: Subject to any disclaimer, the term of this patent is extended or adjusted under 35 U.S.C. 154(b) by 244 days.

(21) Appl. No.: 10/711,923

(22) Filed: Oct. 13, 2004

(65) Prior Publication Data

US 2006/0078088 A1 Apr. 13, 2006

(51) Int. Cl.
*H05G 1/54* (2006.01)

(52) U.S. Cl. ..... 378/118; 378/111

(58) Field of Classification Search ..... 378/111, 378/117, 118

See application file for complete search history.

(56) References Cited

U.S. PATENT DOCUMENTS 1,647,478 A * 11/1927 Smith ..... 378/92
2,524,240 A * 10/1950 Titterton et al. ..... 378/106
3,320,477 A * 5/1967 Boeker ..... 315/307
3,502,877 A * 3/1970 Splain ..... 378/96
3,521,067 A * 7/1970 Splain ..... 378/110
3,643,094 A * 2/1972 Courtois ..... 378/106
4,104,526 A * 8/1978 Albert ..... 378/106
4,322,625 A * 3/1982 Daniels et al. ..... 378/110
4,402,086 A * 8/1983 Setbon ..... 378/112
4,408,247 A * 10/1983 Cowell ..... 361/79
4,601,051 A * 7/1986 Santurtun et al. ..... 378/118
4,638,500 A * 1/1987 Smits et al. ..... 378/109
4,899,354 A * 2/1990 Reinhold ..... 378/34
4,995,069 A * 2/1991 Tanaka ..... 378/200
5,132,999 A * 7/1992 Wirth ..... 378/101
5,495,165 A * 2/1996 Beland ..... 323/270
6,205,200 B1 * 3/2001 Boyer et al. ..... 378/101
6,507,174 B1 * 1/2003 Qian ..... 323/222
6,541,927 B2 * 4/2003 Yamashita ..... 315/381
2002/0030451 A1 * 3/2002 Moisin ..... 315/219

* cited by examiner

*Primary Examiner*—Edward J. Glick
*Assistant Examiner*—Thomas R. Artman

(57) ABSTRACT

An imaging tube (30) includes multiple high voltage elements (64). A voltage-clamping device (70) is coupled between the high voltage elements (64) and prevents the occurrence of overvoltage transients in the minor insulation of an imaging tube (30).

16 Claims, 4 Drawing Sheets

X-RAY TUBE CATHODE OVERVOLTAGE TRANSIENT SUPRESSION APPARATUS

TECHNICAL FIELD

The present invention relates generally to X-ray and computed tomography systems. More particularly, the present invention relates to an apparatus for suppressing the overvoltage transients experienced by a cathode of an X-ray tube.

BACKGROUND OF THE INVENTION

An X-ray system typically includes an X-ray tube. The X-ray tube generates X-rays across a vacuum gap between a cathode and a rotating anode structure. In order to generate the X-rays, a filament driving circuit generates thermo-ionic current from the cathode. In releasing of the electrons, the filaments contained within the cathode are heated to incandescence by passing an electric current therein. The electrons are accelerated by the high voltage potential and impinge upon the anode, whereby they are abruptly slowed down to produce X-rays in the form of an X-ray beam.

The high voltage potential across the vacuum gap is typically on the order of 140 kV. Although the filament driving circuit is operated at this high voltage potential, the actual voltage between the terminals of filament driving circuit leads is low and is approximately on the order of tens of volts. Even though the driving circuit is often isolated and the filament wires are insulated, as a result of the voltage difference between the high voltage potential across the vacuum gap and the low operating voltage of the driving circuit, overvoltage transients occur therein.

The overvoltage transients can also be caused from floating high voltage structure, discharges caused by insulator surface contamination, and filament shorting in the cathode. Floating high voltage structure refers to bad contacts on the cathode and between the cathode and the driving circuit. The overvoltage transients occur in the form of discharges or spits. Abnormal discharges occur when the filaments are temporarily or permanently shorted to the cathode cup, which may be in the form of pin-to-pin discharges. The discharges can cause degradation to the minor insulation on the leads and the cathode cable terminals.

The spit activity causes radiated and conducted electrical noise of high intensity, which can interfere with operations of electronic circuitry in the vicinity of the tube, to the extent of the X-ray system becoming inoperative. Also, the insulation between the filaments is only capable of protecting against voltage potential discharges of approximately between 1 kV and 5 kV, thus, the filament insulation can also breakdown from the spit activity. Acceleration of insulation breakdown increases over time and can cause the X-ray system to operate inappropriately and eventually become inoperative.

The overvoltage transients can also cause high voltage degradation to the feedthrough insulators and breakdown in the minor insulation of a high voltage cable between the cathode and the driving circuit. The loss of high voltage integrity between filaments and common in the high voltage cable can result in instable or uncontrollable high voltage regulation.

The overvoltage transients are especially critical in mono-polar X-ray tubes that have a relatively higher power capacity. The overvoltage transients are more predominant in the mono-polar tube applications and therefore, X-ray tube component degradation is also more predominant.

Thus, there exists a need for an apparatus that prevents the occurrence of overvoltage transients within an X-ray tube.

SUMMARY OF THE INVENTION

The present invention provides an apparatus for preventing overvoltage transients within an imaging tube. An imaging tube is provided and includes multiple high voltage elements. A voltage-clamping device is coupled between the high voltage elements and prevents the occurrence of overvoltage transients in the imaging tube.

The embodiments of the present invention provide several advantages. One such advantage is the provision of clamping devices between the high voltage elements of an imaging tube. In so doing, the overvoltage transients between the high voltage elements of the imaging tube are minimized. The minimization of the overvoltage transients increases imaging tube component life and thus, aids in maintaining proper functioning of the components and increases reliability of the imaging tube.

Another advantage that is provided by multiple embodiments of the present invention is the provision of voltage-clamping devices that serve as insulators for predetermined differential voltage potentials between high voltage elements of an imaging tube. By serving also as insulators, the clamping devices further protect the high voltage elements from the internal environment of an imaging tube and increase life of the high voltage elements and components adjacent thereto.

Furthermore, another advantage that is provided by multiple embodiments of the present invention is the provision of voltage-clamping devices that do not detrimentally affect imaging tube performance and are capable of withstanding physical contact with oil, high temperatures, and high X-ray exposure, such as experienced within an imaging tube.

The present invention itself, together with attendant advantages, will be best understood by reference to the following detailed description, taken in conjunction with the accompanying figures.

BRIEF DESCRIPTION OF THE DRAWING

For a more complete understanding of this invention reference should now be had to the embodiments illustrated in greater detail in the accompanying figures and described below by way of examples of the invention wherein.

DETAILED DESCRIPTION

Figure 1:
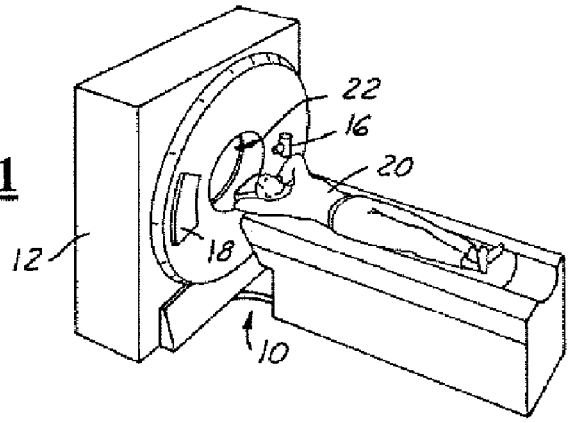
FIG. 1 is a pictorial view of an imaging system having an imaging tube utilizing voltage-clamping devices in accordance with an embodiment of the present invention.

In each of the following figures, the same reference numerals are used to refer to the same components. While the present invention is described with respect to an apparatus for suppressing overvoltage transients experienced by a cathode of an imaging tube, the present invention may be adapted to be used in various systems including: radiotherapy systems, X-ray imaging systems, computed tomography systems, and other imaging systems that use imaging tubes.

In the following description, various operating parameters and components are described for one constructed embodiment. These specific parameters and components are included as examples and are not meant to be limiting.

Also, in the following description the term "high voltage element" may refer to any high voltage wire, contact, lead, line, filament, pin, or other high voltage element known in the art. A high voltage element may refer to any high voltage contact or electrical conduit between components of an imaging system. Various example high voltage elements are provided in the following description and accompanying figures.

Referring now to FIG. 1, a pictorial view of an imaging system 10 utilizing voltage-clamping devices in accordance with an embodiment of the present invention is shown. The imaging system 10 includes a gantry 12 that has an imaging tube 16. The imaging tube 16 projects a beam of X-rays toward a detector array 18. The X-rays after passing through the medical patient 20, within the patient bore 22, are detected and used to create a CT image.

Figure 2:
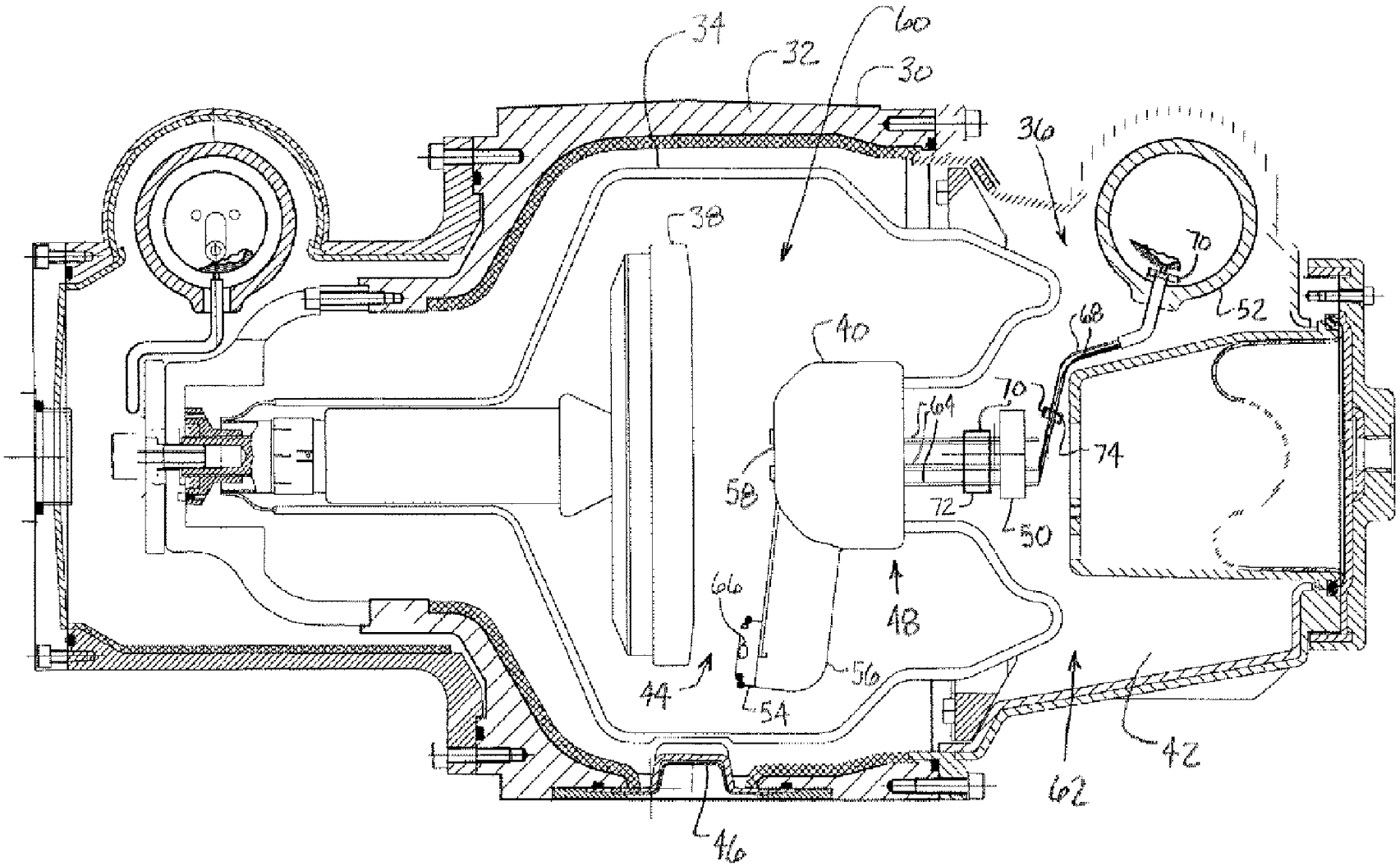
FIG. 2 is a cross-sectional view of a bi-polar imaging tube of FIG. 1 in accordance with an embodiment of the present invention.

Referring now to FIG. 2, a cross-sectional view of a bi-polar imaging tube 30 in accordance with an embodiment of the present invention is shown. The imaging tube 30 includes an exterior housing 32 having an insert 34 and a cathode circuit 36 contained therein. The insert 34 may be formed from glass and contains a rotating anode 38 and a cathode 40. The insert 34 is surrounded by the oil 42, which is circulated around the insert 34 and cooled via a pump and a heat exchanger (both of which are not shown). Electrons pass from the cathode cup 54 to the rotating anode 38 across a vacuum gap 44 where they impinge on the anode 38 and produce X-rays. The X-rays then pass through a window 46 in the housing 32 for scanning purposes.

The cathode circuit 36 includes a cathode assembly 48, a cathode receptacle 52, and a cathode driving circuit (not shown). The cathode assembly 48 includes a cathode cup 54 that is located within the insert 34 whereas the cathode terminal board 50 and the receptacle 52 are located outside of the insert 34. The receptacle 52 is coupled to a high voltage generator and filament drive circuit (both of which are not shown). The cathode cup 54 is coupled to an arm 56, which extends from a base or shell 58. The shell 58 separates a vacuum cavity 60 of the insert 34 from an oil cavity 62 that surrounds the insert 34. High voltage leads 64 extend from one or more filaments 66 (only one is shown) in the cathode cup 54 through the arm 56 and the shell 58 to the terminal board 50. The terminal board 50 is coupled to the receptacle 52 via the high voltage connections 68.

Power is received by the filaments 66 from the receptacle 52 and under control of the driving circuit. The power is supplied from the receptacle 52 to the terminal board 50 via the high voltage connections 68. The power is then supplied from the terminal board 50 to the filaments 66 via the high voltage leads 64. Besides holding HV leads in place, the terminal board 50 may also be utilized to offer additional bleeding resistance for the filaments 66, when temporary over-voltage occurs.

The cathode circuit 36 also includes multiple voltage-clamping devices 70. The clamping devices 70 may be coupled in parallel with and are substantially higher in resistance than the filaments 66. As such, the voltage-clamping devices 70 do not affect voltage regulation of the cathode circuit 36 and performance of the driving circuit. The voltage-clamping devices 70 include a first clamping device 72, a second clamping device 74, and a third clamping device 76. The first clamping device 72 is coupled to the leads 64. The second clamping device 74 is coupled to the connections 68 between the terminal board 50 and the receptacle 52. The third clamping device 76 is coupled to the HV connections 68 within the receptacle 52. The clamping devices 70 have a predetermined resistance and prevent overvoltage transients from occurring between the leads 64 and the HV connections 68. The clamping devices 70 perform as insulators and as voltage limiters.

When voltage potential between high voltage elements, such as between the leads 64 and the HV connections 68, is below a predetermined voltage level the clamping devices 70 perform as insulators and isolate the elements 64 and 68 from each other. The clamping devices 70 prevent the flow of current between the high voltage elements 64 and 68.

When the voltage between the high voltage elements 64 or 68 is greater than or equal to the predetermined voltage level the clamping devices 70 allow the flow of current between the high voltage elements 64 or 68. Thus, the clamping devices 70 prevent voltage potential between the high voltage elements 64 or 68 from exceeding the predetermined voltage level.

The clamping devices 70 may be of various types, styles, sizes, shapes, and may be formed of various materials. The clamping devices 70 may be in the form of varistors, feed through varistors, resistive jumpers, and bleeding resistors, and may be formed of a resistive material, a resistive epoxy, and a semi-conductor epoxy. The clamping devices 70 may be in the form of a terminal board formed of resistive material or may be in some other form known in the art. The clamping devices 70 may, for example, be annular or disk like in shape, as shown. Also, any number of clamping devices 70 may be used throughout the imaging tube 30.

The clamping devices 70 may be coupled between any high voltage elements including between cathode filaments, a cathode grid, and a cathode common, such as filaments 66, cathode cup 54, and return lines of the filaments. The clamping devices 70 may be voltage-clamping devices or may perform as current limiting devices. Several examples of clamping devices are described below.

In one embodiment of the present invention the clamping devices 70 are in the form of metal oxide varistors formed of oxide zinc material. The clamping devices 70 may be formed of oxide zinc, silicone carbide, some other material known in the art, or a combination thereof. The use of varistors limits high frequency high voltage transients due to quick response time of the varistors.

Although the clamping devices described above and in the following figures are shown in particular locations, these locations are for example purposes only. The clamping devices may be located elsewhere.

Figure 3:
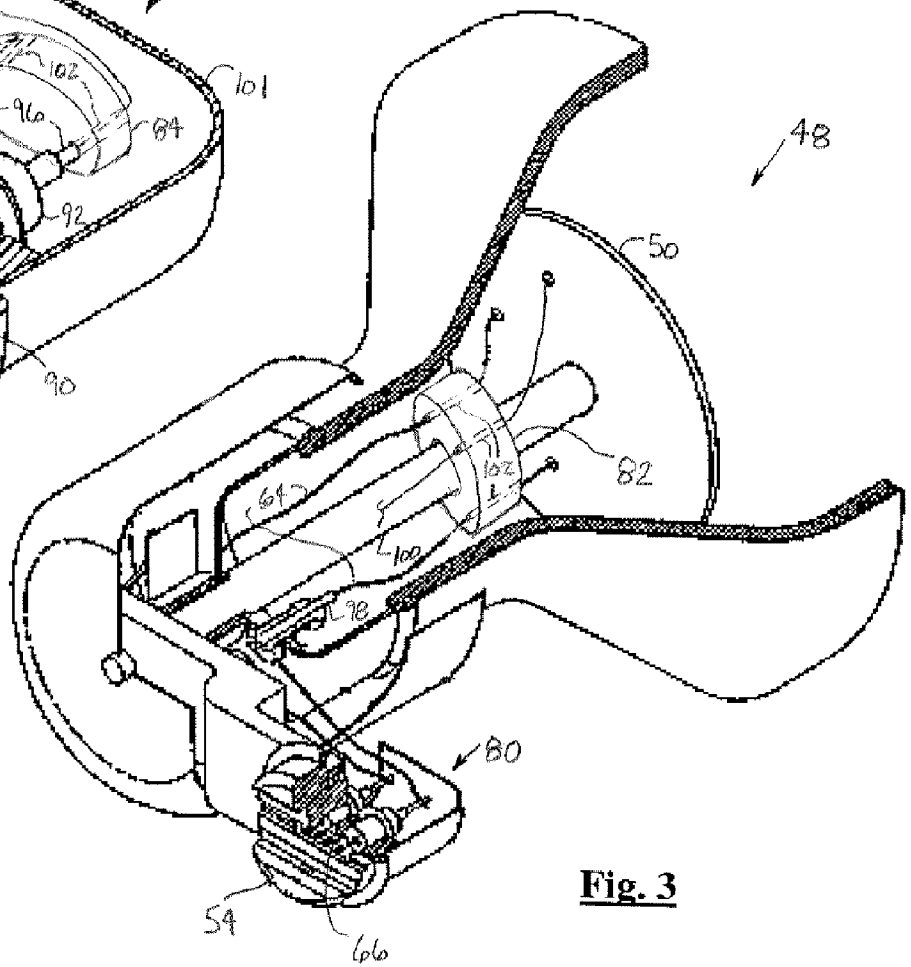
FIG. 3 is a perspective sectional view of a cathode assembly for a bi-polar imaging tube incorporating a voltage-clamping device in accordance with another embodiment of the present invention.
Figure 4:
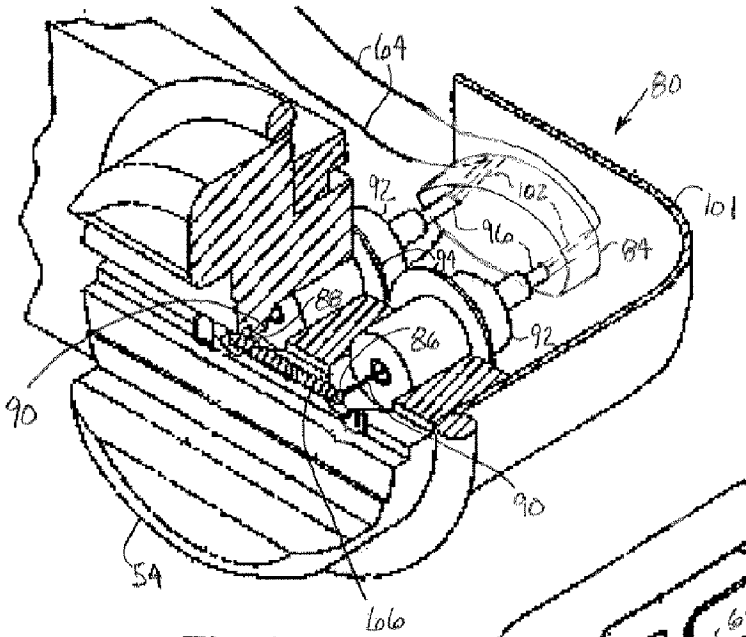
FIG. 4 is a close-up perspective sectional view of a cathode cup assembly for a bi-polar imaging tube incorporating a voltage-clamping device in accordance with another embodiment of the present invention.

Referring now to FIGS. 3 and 4, a perspective sectional view of the cathode assembly 48 and a close-up perspective sectional view of a cathode cup assembly 80 for a bi-polar imaging tube, such as the imaging tube 30, in accordance with another embodiment of the present invention are shown. The assemblies 48 and 80 include a support post-clamping device 82 and a terminal-clamping device 84, respectively.

The cathode cup assembly 80 includes the cathode cup 54 having the filament 66. The filament 66 has a large focal spot end 86 and a common end 88. Each of the ends 86 and 88 are coupled to a pair of high voltage extensions 90 that extend through a pair of feedthrough insulators 92. The feedthrough insulators 92 are coupled to the cup 54 via a pair of washers 94. The washers 94 are brazed to the cup 54. The extensions 90 are coupled to a pair of terminals 96 that are in turn coupled to the high voltage leads 64. The leads 64 extend through an eyelet 98 and then along a support rod 100 to the terminal board 50. The post-clamping device 82 is coupled to the leads 64, proximate to the terminal board 50, which is in oil. The terminal-clamping device 84 is coupled to the leads 64, proximate to the terminals 96, which is in vacuum environment. The terminal-clamping device 84 is sized and shaped as to fit within the mask 101.

Both the insulators 92 and the terminal board 50 may be formed of resistive material and perform as clamping devices. In order for the insulators 92 to perform as clamping devices they are formed of a resistive semi-conductive material instead of being formed of a insulation material, as in prior art systems. The insulators 92 are conductive for predetermined voltage levels, across the insulators 92, that are above the predetermined voltage level.

Similar to the clamping devices 70, the clamping devices 82 and 84 may be in the form of resistive jumpers or formed of resistive material, such as resistive epoxy. In the embodiment of FIGS. 3 and 4, the clamping devices 82 and 84 are shown as varistor disks with feedthrough holes 102. The leads 64 extend through the feedthrough holes 102.

Figure 5:
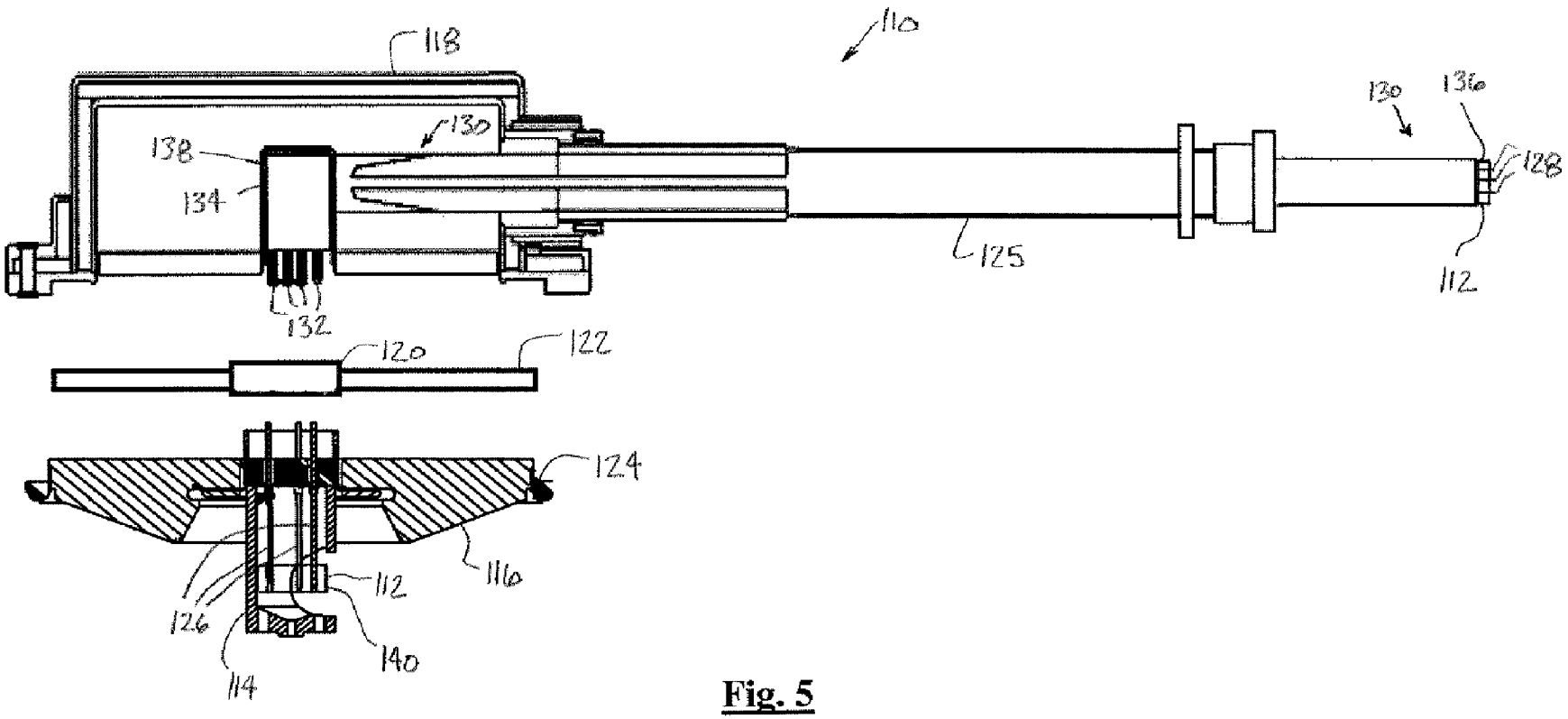
FIG. 5 is a cross-sectional side exploded view of a cathode assembly for a mono-polar imaging tube incorporating voltage-clamping devices in accordance with another embodiment of the present invention.

Referring now to FIG. 5, a cross-sectional side exploded view of a cathode assembly 110 for a mono-polar imaging tube (not shown) incorporating clamping devices 112 in accordance with another embodiment of the present invention is shown. The cathode assembly 110 includes a cathode post 114 from which the cathode cup (not shown) is attached. The cathode post 114 is an integrated part of a high voltage insulator 116. The cathode HV leads are coupled to a flat high voltage connector 118 via an adaptor 120. A gasket 122 is coupled between the insulator 116 and the connector 118. The insulator 116 is coupled to a mono-polar imaging tube insert or frame 124. A power cable 125 is coupled to the connector 118 by which power is transferred to the cathode assembly 110.

A first set of high voltage leads 126 exist within the cathode post 114 and a second set of high voltage pins 128 (pins are only shown for one side of the cable) exist on each end 130 of the cable 125. The second set of pins 128 are coupled to a third set of pins 132 and are located within Faraday cup 134 of the connector 118. Power is received by the first set of pins 126 in the cathode post 114 via the power cable 125 and through the connector 118.

The voltage-clamping devices 112 include a pair of cable voltage-clamping devices 136 (only one is shown) located on each of the ends 130 and coupled between the second set of pins 128. The voltage-clamping devices 112 also include a Faraday cup voltage-clamping device 138 and a cathode post voltage-clamping device 140. In an example embodiment, the Faraday cupvoltage-clamping device 138 is in the form of resistive epoxy that fills and resides within the cathode cup 134, as shown. In another example embodiment, the post voltage-clamping device 140 is in the form of a varistor disk that resides within the post 114 and is coupled between the first set of pins 126. The clamping devices 112 may be located in various other locations of the cathode assembly 110, such as in the adaptor 120.

Figure 6:
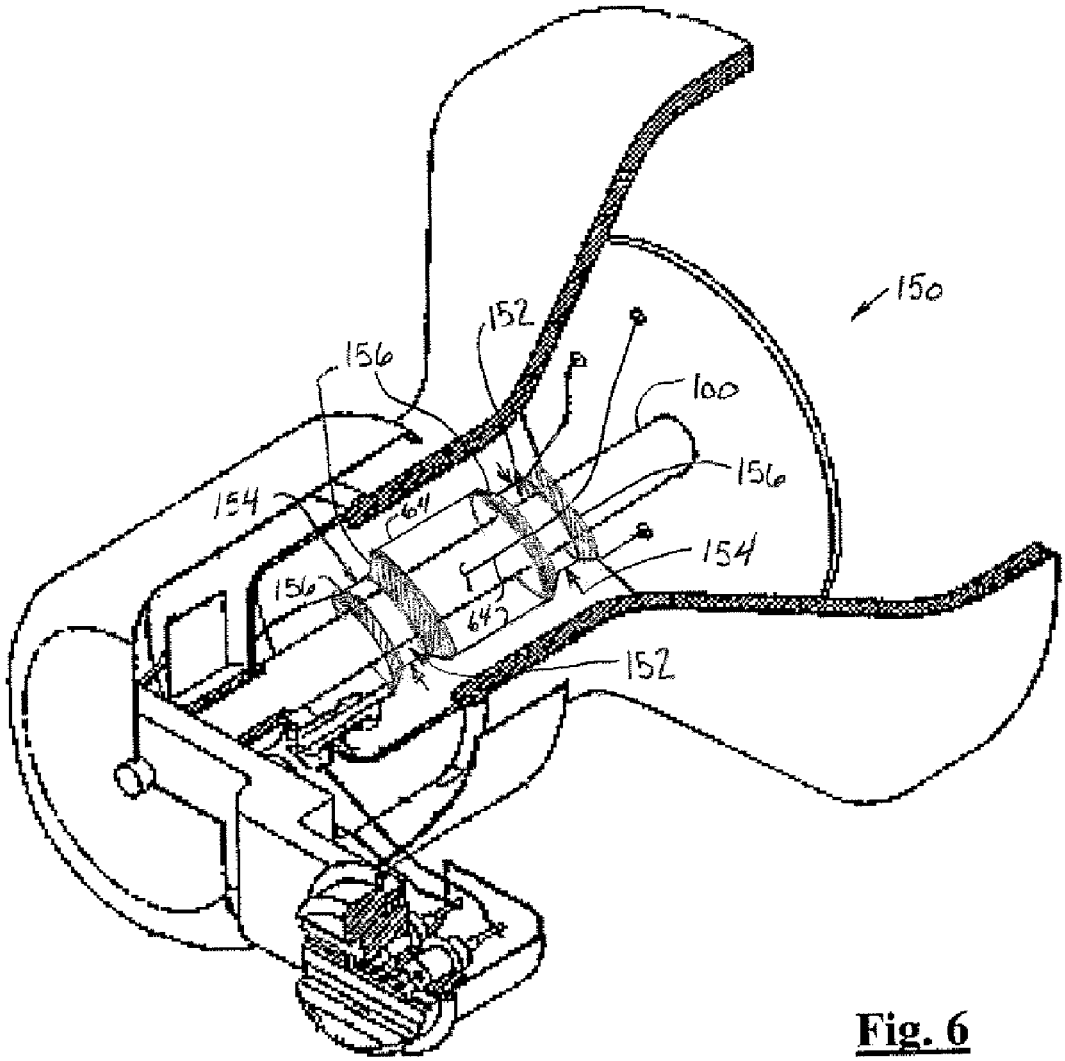
FIG. 6 is a perspective sectional view of a cathode assembly having multiple discharge gaps in accordance with another embodiment of the present invention.

Referring now to FIG. 6, a perspective sectional view of a cathode assembly 150 having multiple predesigned discharge gaps 152 in accordance with another embodiment of the present invention is shown. The cathode assembly 150 includes the leads 64 that are oriented such that the minimum distances between the leads 64 correspond with the discharge gaps 152. The discharge gaps 152 have predetermined distances therebetween, represented by the numerical designators 154, which allow for controlled discharges of current between the leads 64 across the gaps 152. The discharges occur for a predetermined voltage potential across the gaps 152 that correspond directly to the size of the gaps 152. The discharge gaps 152 are maintained by the high voltage element separators 156.

The discharge gaps 152 as with the above mentioned clamping devices also provide protection to the insulation between the high voltage elements. The discharge gaps 152 may be of various sizes, be in various locations, and may be maintained using various techniques known in the art.

The separators 156 maintain the separation of the leads 64 over the gaps 152 to be at a predetermined distance, such as distances 154. The separators 156 also maintain the distances between other portions of the leads 64, that are not over the gaps 152, such that they are greater than the predetermined distance. The separators 156 by maintaining the designated portions of the leads 64 to have gaps 152 therebetween, assures discharges across the gaps 152 and that the discharges are of a controlled size and current level. The separators 156 may be of various sizes, shapes, and styles. In the example embodiment, the separators 156 are in the form of disks that are coupled to the support rod 100.

The present invention provides an apparatus for suppressing the overvoltage transients within an imaging tube. The apparatus is versatile in that it may be applied to bi-polar and mono-polar imaging tubes. The present invention increases imaging tube reliability and life of components therein.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A cathode circuit for an imaging tube comprising:

a plurality of high voltage elements; and at least one voltage-clamping device coupled between said plurality of high voltage elements and preventing occurrence of overvoltage transients in the cathode circuit;

wherein said at least one voltage-clamping device comprises a plurality of feedthrough holes.

2. A cathode circuit for an imaging tube comprising:

a plurality of high voltage elements; and at least one voltage-clamping device coupled between said plurality of high voltage elements and preventing occurrence of overvoltage transients in the cathode circuit;

wherein said at least one voltage-clamping device is a terminal board formed of resistive or semi-resistive material.

3. An imaging tube comprising:

a cathode cup;

a cathode terminal board coupled to said cathode cup via a first set of high voltage elements;

a high voltage receptacle coupled to said cathode terminal board via a second set of high voltage elements; and a plurality of voltage clamping devices coupled to and preventing occurrence of overvoltage transients across said first set of high voltage elements and said second set of high voltage elements.

4. A cathode circuit for an imaging tube comprising:

a receptacle coupled to a terminal board via a first set of high voltage elements;

the terminal board coupled to at least one filament via a second set of high voltage elements;

at least one voltage clamping device coupled to the first set of high voltage elements between the receptacle and the terminal board; and at least one voltage clamping device coupled to the second set of high voltage elements between the terminal board and the at least one filament.

5. The cathode circuit of claim 4, further comprising at least one voltage clamping device coupled to the first set of high voltage elements within the receptacle.

6. The cathode circuit of claim 5, wherein the at least one voltage-clamping device is a discharge gap.

7. The cathode circuit of claim 5, wherein the at least one voltage-clamping device is formed of a resistive material.

8. The cathode circuit of claim 5, wherein the at least one voltage-clamping device is a resistive jumper.

9. The cathode circuit of claim 5, wherein the at least one voltage-clamping device is a varistor.

10. The cathode circuit of claim 5, wherein the at least one voltage-clamping device is a metal oxide varistor.

11. A cathode assembly for an imaging tube comprising:

a cathode post including a first set of high voltage elements;

a cathode cup assembly coupled to the cathode post including a second set of high voltage elements;

at least one voltage clamping device coupled to said first set of high voltage elements; and at least one voltage clamping device coupled to said second set of high voltage elements.

12. The cathode circuit of claim 11, wherein the at least one voltage-clamping device is a discharge gap.

13. The cathode circuit of claim 11, wherein the at least one voltage-clamping device is formed of a resistive material.

14. The cathode circuit of claim 11, wherein the at least one voltage-clamping device is a resistive jumper.

15. The cathode circuit of claim 11, wherein the at least one voltage-clamping device is a varistor.

16. The cathode circuit of claim 11, wherein the at least one voltage-clamping device is a metal oxide varistor.

* * * * *